United States Patent [19]

Pounder et al.

[11] Patent Number: 4,487,333

[45] Date of Patent: Dec. 11, 1984

[54] FLUID DISPENSING SYSTEM

[75] Inventors: Edwin Pounder, LaCanada; Alan J. Arena; Michael Pawlowski, both of Chino; Adrian M. Totten, El Monte, all of Calif.

[73] Assignee: Signet Scientific Co., El Monte, Calif.

[21] Appl. No.: 352,753

[22] Filed: Feb. 26, 1982

[51] Int. Cl.[3] ..... B65B 3/04

[52] U.S. Cl. ..... 222/54; 222/14; 222/71; 222/129.4; 222/504; 377/21; 364/509; 73/861.02

[58] Field of Search ..... 222/14, 15, 16, 17, 222/20, 21, 22, 52, 54, 71, 129.1–129.4, 134, 135, 504; 194/3, 5, 13; 235/92 FL; 73/861.01, 861.02, 861.03; 364/509, 510; 377/21, 25

[56] References Cited

U.S. PATENT DOCUMENTS

| | | | |
|---|---|---|---|
| 3,229,077 | 1/1966 | Gross | 235/151.34 |
| 3,310,203 | 3/1967 | McCann | 222/54 |
| 3,410,293 | 11/1968 | Ernyei | 137/112 |
| 3,448,408 | 6/1969 | Wapner et al. | 222/54 X |
| 3,484,590 | 12/1969 | Stanton | 235/151.12 |
| 3,486,013 | 12/1969 | Stanton | 235/151.12 |
| 3,504,686 | 4/1970 | Cooper et al. | 137/3 |
| 3,549,514 | 12/1970 | Brown et al. | 208/33 |
| 3,659,631 | 5/1972 | Rakoske | 137/596.17 |
| 3,695,314 | 10/1972 | Watts et al. | 141/59 |
| 3,777,935 | 12/1973 | Storey | 222/16 |
| 3,940,600 | 2/1976 | Alexander et al. | 235/151.12 |
| 3,945,253 | 3/1976 | Liu et al. | 73/861.02 |
| 4,200,203 | 4/1980 | Rider | 222/14 |
| 4,202,387 | 5/1980 | Upton | 222/54 X |
| 4,204,612 | 5/1980 | Schrader et al. | 222/54 X |
| 4,331,025 | 5/1982 | Ord | 73/861.02 X |
| 4,341,327 | 7/1982 | Zeitz | 222/135 X |

*Primary Examiner*—Joseph J. Rolla
*Attorney, Agent, or Firm*—Pretty, Schroeder, Brueggemann & Clark

[57] ABSTRACT

A fluid dispensing method and apparatus particularly adapted for post-mix dispensing of a soft drink, with accurate relative proportions of carbonated water and soft drink syrup. Separate syrup and water valves are controllably turned on and off, independently, at prescribed duty cycles, to provide a prescribed mix ratio, and syrup and water flow meters monitor the instantaneous flow rates of the water and syrup to minimize the effects of any pressure variations in the initial syrup and water supplies. The apparatus is conveniently modified for use with different soft drink syrups using a separate removable personality module for each syrup, characterizing its prescribed mix ratio and its viscosity.

27 Claims, 8 Drawing Figures

DISPENSING LOOP

FLUID DISPENSING SYSTEM

BACKGROUND OF THE INVENTION

This invention relates generally to fluid dispensing systems, and more particularly to systems for mixing two fluids together in prescribed relative proportions and to systems for supplying a fluid at a prescribed average flow rate.

Systems of this type are of particular use as post-mix soft drink dispensers for mixing together and dispensing carbonated water and flavored soft drink syrup in a prescribed mix ratio. These systems typically inject the water and syrup simultaneously into a mixing chamber, where they are mixed together and then dispensed through a nozzle into a drinking cup. The two fluids are normally supplied for coextensive time durations, and the mix ratio is typically controlled using manually-adjustable metering valves.

Although the typical post-mix dispensing systems described above operate satisfactorily in most situations, variations in the pressure of the carbonated water can sometimes cause corresponding variations in the relative proportions of the dispensed water and syrup. Some systems have overcome this problem by including relatively complex and expensive structures for regulating the water pressure. Other systems have sought to maintain a fixed mix ratio by controllably adjusting a syrup valve in accordance with the water's pressure. It is believed, however, that these systems are unduly sensitive to pressure variations. Also, many of these systems are believed to be unduly complex and to require substantial manual adjustments when changing from one type of syrup to another.

It should therefore be appreciated that there is still a need for a system for mixing together and dispensing two fluids with a prescribed mix ratio, which is substantially insensitive to variations in fluid pressure and which can be conveniently and reliably modified to provide different mix ratios. It should also be appreciated that there is still a need for an inexpensive yet reliable system for supplying a fluid at a prescribed average flow rate, regardless of its initial pressure. The present invention fulfills these needs.

SUMMARY OF THE INVENTION

The present invention is embodied in an improved fluid dispensing apparatus and method for dispensing a first fluid and a second fluid in prescribed relative proportions. The apparatus includes first means for controllably supplying a first fluid, second means for controllably supplying a second fluid, and means for mixing together and dispensing the first and second fluids. In accordance with the invention, the apparatus further includes means for modulating a selected one of the first means and second means in a prescribed fashion, such that the apparatus dispenses the two fluids in prescribed relative proportions. The apparatus is substantially insensitive to variations in the initial pressure of either fluid, and it can operate over a wide range of mix ratios.

More particularly, the selected one of the first means and second means that is modulated by the modulating means includes valve means for turning on and off a supply of the corresponding fluid. The modulating means opens and closes the valve means at a prescribed duty cycle such that the apparatus dispenses the two fluids at a prescribed average mix ratio. Use of such an on/off valve means better facilitates control of the fluid's average flow rate and therefore the fluid mix ratio that the apparatus provides. The apparatus preferably includes a separate valve means for both the first means and the second means, and the modulating means modulates either one, depending on the particular mix ratio that is to be provided.

The apparatus can further include means for sensing the relative flow rates of the two fluids and for producing a corresponding control signal, and means for modulating suitably conditions the control signal to produce a signal for opening and closing the valve means at the prescribed duty cycle. This ensures that any variations in fluid pressure, which could cause variations in fluid flow rate, will be compensated for by the valve means.

The apparatus is particularly suited for use in a post-mix soft drink dispenser, for mixing together and dispensing carbonated water and a selected one of a number of different soft drink syrups. Such a soft drink dispenser preferably includes a separate on/off valve means and flow meter for both a water supply and a syrup supply. In applications such as this, it is sometimes desirable to vary the mix ratio of the two fluids with time, for example to compensate for the presence of melted ice in the bottom of the cup. This is accomplished conveniently by controllably adjusting the duty cycle of one fluid relative to the duty cycle of the other fluid, in a prescribed fashion. Also, it is sometimes desirable to vary the average flow rate of both fluids with time, for example to minimize splashing. This is accomplished conveniently by controllably adjusting the duty cycles of both fluids in the same way, in a prescribed fashion.

In another aspect of the invention, the prescribed mix ratio for the first and second fluids is indicated by a special personality module removably connected to the apparatus. Use of such a module permits the apparatus to be used conveniently with a number of different fluids (e.g., soft drink syrups) having different mixing characteristics, without requiring manual adjustments to be made. The apparatus also preferably includes means for sensing the absence of such a removable module and means for inhibiting operation of the apparatus in such a circumstance.

Many flow meters have output signals that vary with the viscosity of the fluid passing through them. The dispensing apparatus overcomes this problem using means for determining the viscosity of the fluid passing through each flow meter, and means for adjusting its output signal, accordingly. The adjusted signal therefore more accurately indicates the fluid's actual flow rate, and this adjusted signal is suitably conditioned for use by the modulating means in achieving the prescribed mix ratio.

Fluid viscosity ordinarily varies with temperature, so the means for determining the viscosity makes that determination in part by measuring the fluid's temperature. Also, the relationship between temperature and viscosity for the particular fluid in question is preferably indicated by the removable personality module. This facilitates a reliable conversion of the apparatus for use with fluids having different temperature/viscosity characteristics.

The on/off valve means can sometimes be of a type for which there is at least limited uncertainty in the time delay between the time a signal is coupled to the valve means to close it, and the time the valve means actually closes. This uncertainty can adversely affect the duty cycle that the apparatus provides. To correct for this effect, the apparatus monitors the velocity signal output by the flow meter and compares it to a reference signal, to estimate better when the valve means actually closes. The apparatus then measures the time delay from the time the signal is coupled to the valve means to close it until the estimate of the actual closure time, and adjusts the valve control signal during the next cycle, accordingly.

Another aspect of the invention is embodied in an apparatus for dispensing a single fluid at a prescribed average flow rate. The apparatus includes valve means for controllably turning on and off a fluid supply, means for sensing the fluid's instantaneous flow rate and for producing a corresponding velocity signal, and means for conditioning the velocity signal to produce a valve control signal for opening and closing the valve means at a prescribed duty cycle. The duty cycle is appropriately selected such that the valve means dispenses the fluid at the prescribed average flow rate. Many of the aspects of the inventions described earlier with respect to the system for mixing together two fluids in prescribed relative proportions are equally applicable to this embodiment.

Other aspects and advantages of the present invention should become apparent from the following description of the preferred embodiment, taken in conjunction with the accompanying drawings, which illustrate, by way of example, the principles of the invention.

DESCRIPTION OF THE PREFERRED EMBODIMENT

Figures 1, 2:
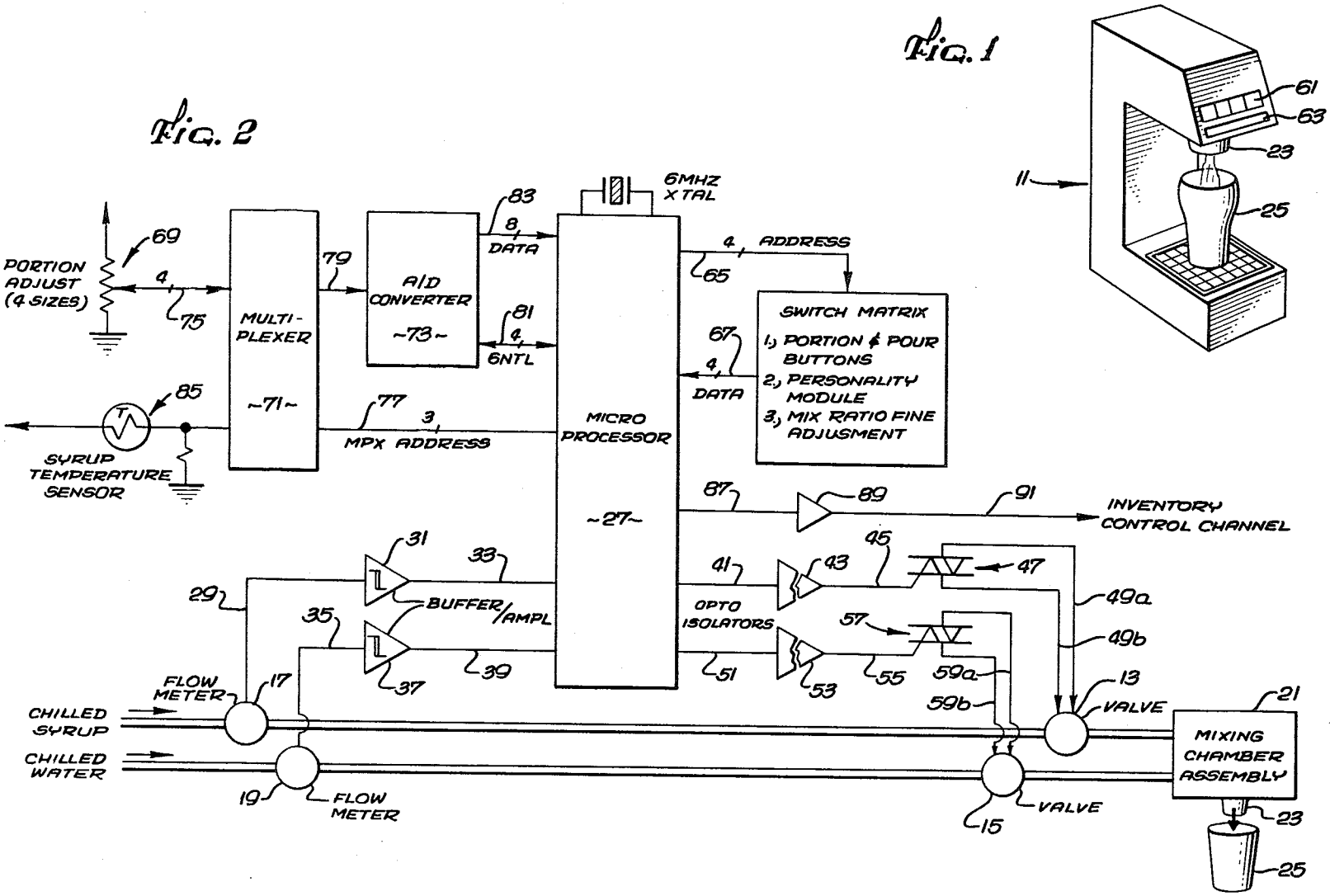
FIG. 1 is a simplified perspective view of a post-mix soft drink dispensing apparatus embodying the principles of the present invention.
FIG. 2 is a simplified block diagram of the dispensing apparatus of FIG. 1, for mixing together carbonated water and a soft drink syrup in a prescribed mix ratio.

Referring now to the drawings, and particularly to FIGS. 1 and 2, there is shown a post-mix soft drink dispensing apparatus 11 embodying the present invention, for mixing together and dispensing a soft drink syrup and carbonated water in prescribed relative proportions. The apparatus includes a syrup valve 13 for turning on and off a supply of syrup and a water valve 15 for turning on and off a supply of water. The apparatus further includes a syrup flow meter 17 upstream of the syrup valve for measuring the syrup's flow rate, and a water flow meter 19 upstream of the water valve for measuring the water's flow rate. The syrup and water transmitted by the two valves are mixed together in a mixing chamber assembly 21 and dispensed through a nozzle 23 into a drinking cup 25.

In accordance with the invention, the apparatus further includes control means, including a microprocessor 27, for controllably opening and closing both the syrup valve 13 and the water valve 15 with prescribed duty cycles, such that the apparatus dispenses the soft drink syrup and water with a prescribed mix ratio. The two valves are cycled open at the same time, the syrup valve remaining open until it has dispensed about 0.15 ounces of syrup, and the water valve remaining open for whatever duration provides the prescribed mix ratio. This ratio is typically between about 3.5 to 1 and 6.0 to 1, depending on the particular syrup being dispensed. The peak flow rate of the water is higher than that for the syrup, to reduce the disparity between their respective duty cycles. As soon as both valves have dispensed the appropriate amounts of fluid, the cycle is repeated by again opening the water and syrup valves simultaneously. This cycling continues until a prescribed volume has been dispensed into the cup 25.

More particularly, and with particular reference to FIG. 2, both the syrup flow meter 17 and the water flow meter 19 are paddle wheel-type flow meters producing velocity signals in the form of pulse sequences having frequencies proportional to the flow rates of the fluids passing through them. One suitable such flow meter is described in a copending application for U.S. patent, Ser. No. 352,534, filed Feb. 26, 1982, in the names of Edwin Pounder et al., which is incorporated by reference. The pulse sequence signal produced by the syrup flow meter is coupled over line 29 to a buffer/amplifier 31 for conversion to appropriate logic levels, and in turn over line 33 to the microprocessor 27. Similarly, the pulse sequence signal produced by the water flow meter is coupled over line 35 to a buffer/amplifier 37, and in turn over line 39 to the microprocessor.

The microprocessor 27 suitably processes the syrup and water pulse sequence signals received from the syrup and water flow meters 17 and 19, respectively, and generates syrup and valve drive signals for coupling to the respective syrup and water valves 13 and 15, to open and close them at the appropriate times. The syrup drive signal is coupled over line 41 to an opto-isolator 43 and in turn over line 45 to a triac 47, which outputs two corresponding drive signals for coupling over lines 49*a* and 49*b* to the syrup valve 13, to open and close the valve correspondingly. Similarly, the water drive signal is coupled over line 51 to an opto-isolator 53 and in turn over line 55 to a water triac 57, which outputs two corresponding drive signals for coupling over line 59*a* and 59*b* to the water valve 15, to open and close it correspondingly.

Figures 3, 4:
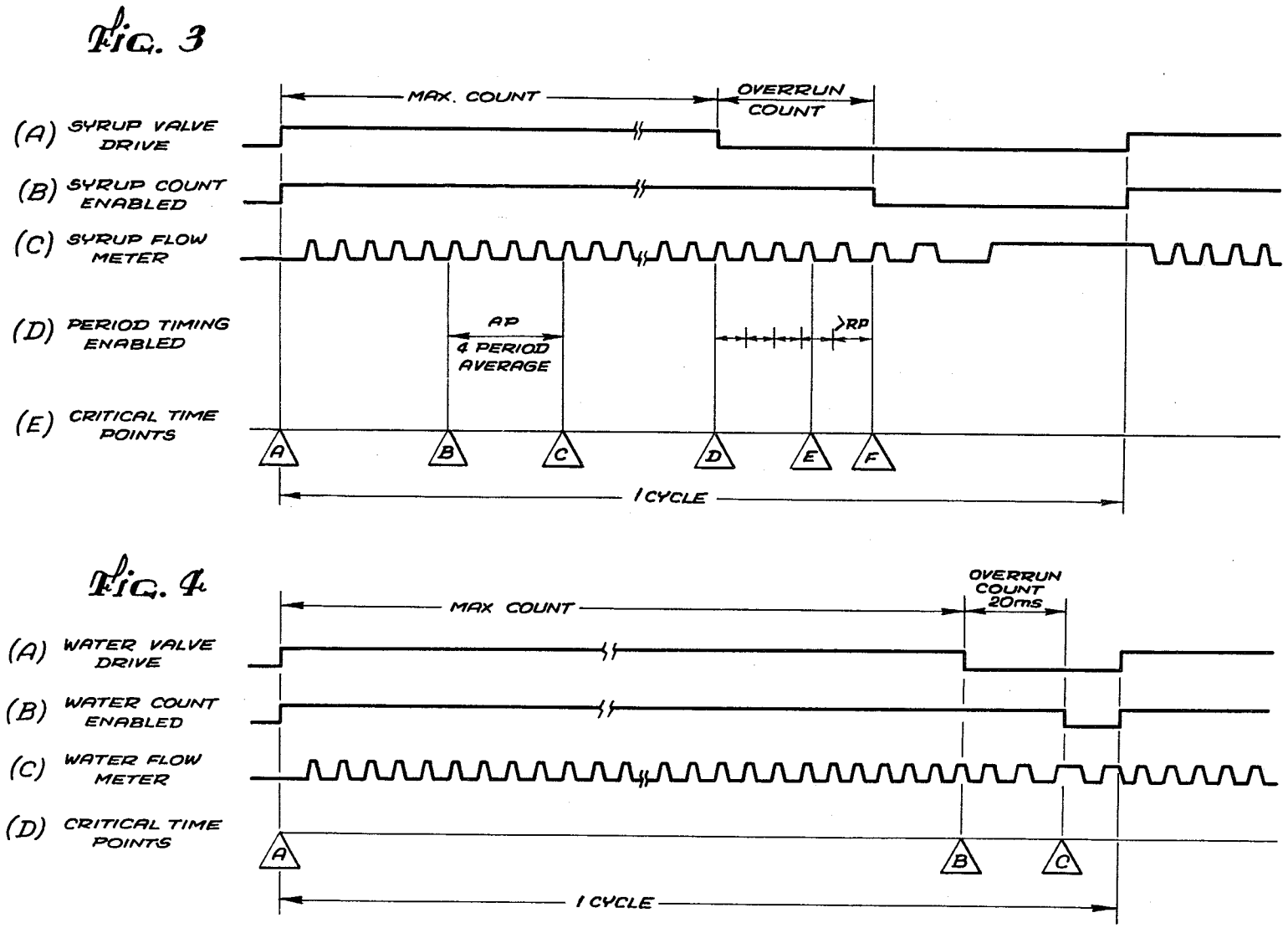
FIG. 3 is a timing diagram of the signals associated with the syrup valve and syrup flow meter of the dispensing apparatus of FIGS. 1 and 2.
FIG. 4 is a timing diagram showing several signals associated with the water valve and water flow meter of the dispensing apparatus of FIGS. 1 and 2.

FIG. 3 depicts the signals associated with the syrup valve 13 and the syrup flow meter 17 for one operating cycle in which the syrup valve is modulated on and off and the water valve 15 remains on essentially continuously. Line A depicts the syrup valve drive signal for controllably opening the syrup valve, line B depicts a syrup count enable signal used internally by the microprocessor 27, and line C depicts the pulse sequence signal produced by the syrup flow meter. During the time the syrup valve is open, the microprocessor counts the successive pulses of the syrup pulse sequence signal and terminates the syrup valve drive signal to close the syrup valve when a prescribed maximum count is reached.

Since the syrup valve 13 is controlled by a triac 47, there is some uncertainty in the exact time at which the valve closes in response to the syrup valve drive signal.

To correct for this uncertainty, the microprocessor 27 implements a special process for monitoring the period between the successive flow meter pulses to determine the time at which the paddle wheel of the syrup flow meter 17 has slowed by a prescribed amount. It then can estimate more accurately the actual time at which the syrup valve closes. The microprocessor then measures the time delay from termination of the syrup valve drive signal to the estimate of the actual valve closure time, and makes an appropriate adjustment to the syrup valve drive signal during the next operating cycle.

More particularly, and with particular reference to the critical time points appearing in line E of FIG. 3, it is observed that the syrup valve drive signal and the syrup count enable signal are both initiated at time A. This opens the syrup valve 13, and the syrup flow meter 17 begins producing the syrup pulse sequence signal for counting by the microprocessor 27. Beginning with the sixth pulse (time B) and continuing to the tenth pulse (time C), the microprocessor averages the period between successive pulses and stores this average value for subsequent use. The averaging is delayed until the first six pulses have been detected to insure that the paddle wheel has accelerated to a stable angular velocity. A four period average is selected because it represents one complete revolution of the flow meter's paddle wheel.

When the running count of syrup pulses being accumulated by the microprocessor 27 reaches the prescribed maximum count, at time D, the microprocessor terminates the syrup valve drive signal, to close the syrup valve 13. As previously discussed, however, an uncertain time delay in operation of the syrup triac 47 prevents the syrup valve from closing for an unspecified time delay, indicated at time E. The microprocessor estimates the timing of this actual closure by monitoring the time period between the successive pulses of the syrup pulse sequence signal after the syrup valve drive signal has terminated. In particular, it compares each of these successive periods to the stored average period that was computed earlier on the basis of pulses six through nine. As soon as this period exceeds the average period by a factor of about 1.375 (time F), the microprocessor determines that the valve has been closed and terminates its internal syrup count enable signal, to stop counting the successive pulses.

The number of pulses occurring after termination of the syrup valve drive signal but before termination of the syrup count enable signal is an overrun count that is used to determine the appropriate maximum count for the next cycle. For example, if the overrun count is particularly high, indicating that the syrup valve 13 closed only after a substantial time delay, then the count for the next cycle is reduced by an appropriate amount, to compensate for the extra amount of syrup dispensed through the syrup valve because of this additional time delay.

FIG. 4 depicts the signals associated with the water valve 15 and water flow meter 19 for one operating cycle in which the water valve is modulated on and off and the syrup valve 13 remains on essentially continuously. Operation of these elements is similar in many respects to operation of the corresponding syrup-related elements. More particularly, the water valve drive signal (line A) opens the water valve at time A and the water flow meter soon begins outputing the water pulse sequence signal (line C). The microprocessor 27 counts the successive pulses of the pulse sequence signal until reaching a prescribed maximum count, at time B, when it terminates the water valve drive signal, to close the water valve. Like the syrup flow meter 17, however, the water flow meter continues to produce output pulses for a short time after the corresponding valve drive signal terminates. The microprocessor counts these pulses for an additional duration of 20 milliseconds, until time C. This additional count is an overrun count that is used to compute the prescribed maximum count for the next operating cycle.

The current cycle is completed when the microprocessor 27 completes its overrun count on the flow meter for the fluid that was modulated off and reaches its maximum cycle count for the other fluid. If the drink has not yet been fully dispensed, the microprocessor again initiates the syrup and water valve drive signals, to begin the next operating cycle.

Referring again to FIG. 1, the apparatus further includes four push-button switches 61 for selecting one of four different drink portion sizes for the apparatus to dispense. The apparatus also includes a pour/cancel push-button switch 63 that functions either to terminate dispensing if one of the four portion size buttons has been previously pushed (i.e., cancel) or, if not, to dispense a drink for as long as it is pushed (i.e., pour). The microprocessor 27 monitors these various switches in a conventional fashion using address lines 65 and data lines 67. The microprocessor controllably opens and closes the syrup and water valves 13 and 15, respectively, in the manner described above, regardless of which one of these particular switches has been pushed. The only significant difference in operation is in the number of cycles necessary to complete the dispensing of the selected drink.

Associated with each of the four portion size switches 61 is a separate potentiometer, one of which is depicted at 69 in FIG. 2. These potentiometers are connected between a positive voltage and ground, and are used to adjust manually the size of the drink dispensed when the corresponding switch has been pushed.

The microprocessor 27 periodically monitors the voltages present at the wipers of the four portion size potentiometers 69 in a conventional fashion using a multiplexer 71 and an analog-to-digital (A/D) converter 73. In particular, the potentiometers are connected by lines 75 to four different input terminals of the multiplexer, and the microprocessor outputs appropriate address signals for coupling over lines 77 to the multiplexer to select a particular one. The voltage on the selected potentiometer is then coupled over line 79 from the multiplexer to the A/D converter, which under control of four control signals supplied on lines 81 from the microprocessor converts the voltage to a corresponding 8-bit digital signal. The digital signal is in turn coupled over lines 83 from the A/D converter to the microprocessor.

The apparatus is adapted for use with a number of different syrups, each having a unique concentration and viscosity/temperature characteristic. As a convenient means of modifying the apparatus for use with each different syrup, the apparatus includes a removable personality module (not shown) for each syrup, containing information that characterizes the syrup. This eliminates the need to perform time-consuming manual adjustments each time the apparatus is adapted for use with a different soft drink syrup.

Each module is appropriately wired to contain eight bits of data. Four of the bits identify the coarse mix ratio for the syrup, and the remaining four bits identify an internal lookup table in the microprocessor 27 that characterizes the syrup's viscosity as a function of temperature. This latter information is used in interpreting the pulse sequence signal output by the syrup flow meter 17, as will be explained below. The microprocessor detects the information stored in the personality module using the same address lines 65 and data lines 67 as are used for the four portion switches 61 and the pour/cancel switch 63.

The apparatus further includes a multiposition switch (not shown) for fine tuning the coarse mix ratio identified by the personality module. This multiposition switch is likewise read using the same address lines 65 and data lines 67 as for the portion and pour/cancel switches 61 and 63, respectively.

An unfortunate characteristic of the syrup flow meter 17 and the water flow meter 19 is that the frequencies of their pulse sequence output signals vary not only with flow rate, but also viscosity. Moreover, syrup viscosity ordinarily varies substantially with temperature. This phenomenon poses a significant problem in soft drink dispensers of this kind, because the syrup passing through the syrup flow meter is frequently refrigerated by varying amounts, depending on the dispensers' frequency of usage.

The dispenser 11 therefore further includes a syrup temperature sensor 85 for providing an accurate indication of the actual temperature and thus viscosity of the syrup passing through the syrup flow meter 17. The microprocessor 27 periodically monitors the voltage output by the temperature sensor using the same multiplexer 71 and A/D converter 73 as are used for monitoring the four portion adjust potentiometers 69.

After the dispenser 11 has completed its dispensing of a drink, the microprocessor 27 outputs a serial data signal representing the contents of its various internal registers, for use by an inventory control system. These registers store data indicating, for example, the amount of syrup and water just dispensed, the temperature of the syrup, and the syrup and water flow rates. The data signal is coupled over line 87 from the microprocessor to a buffer/amplifier 89, and output by the dispenser on line 91.

A flowchart of the process steps implemented by the microprocessor 27 in carrying out the functions described above is depicted in FIGS. 5*a*, 5*b*, 6*a* and 6*b*. After a number of initialization steps depicted at the top of FIG. 5*a*, the program proceeds to either an idle loop depicted at the bottom of FIG. 5*a* or a dispensing loop depicted in FIG. 5*b*. The program ordinarily operates in the idle loop and moves to the dispensing loop only when actually dispensing a drink. Every 0.8 milliseconds, and regardless of the particular step the program is currently implementing, the program is interrupted and proceeds to an interrupt program depicted in FIGS. 6*a* and 6*b*.

Figure 5A:
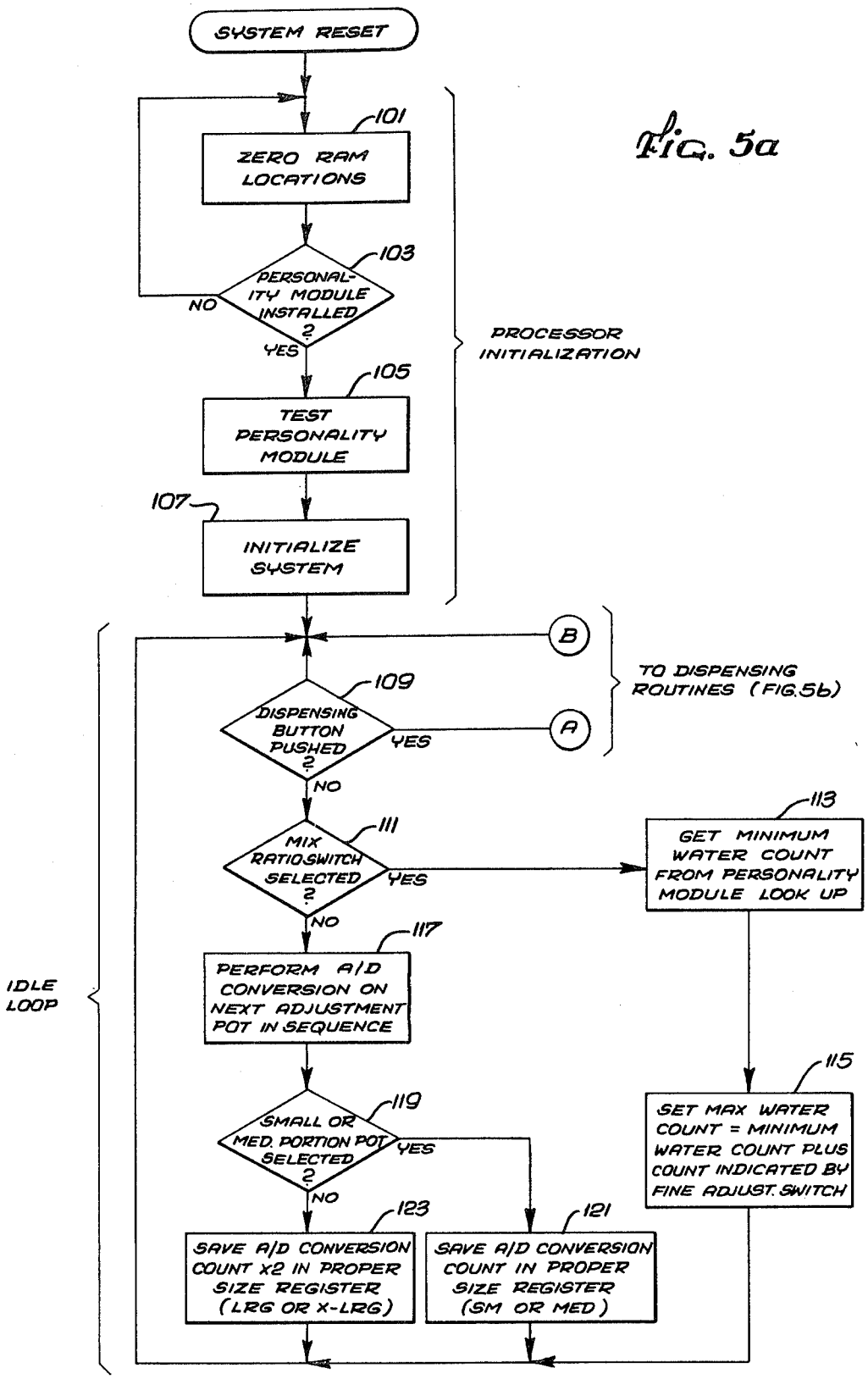
FIGS. 5*a*, 5*b*, 6*a* and 6*b*, together comprise a simplified flowchart of the process steps performed by the microprocessor of the dispensing apparatus of FIGS. 1 and 2 in dispensing a soft drink having the prescribed mix ratio.

With reference now to FIG. 5*a*, the top portion of the figure depicts a number of steps for initializing operation of the microprocessor 27 when the system is first turned on or is reset. An initial step 101 resets to a zero number of internal registers in the microprocessor used in its various operations described below. In step 103, the microprocessor determines whether or not a removable personality module, which characterizes the syrup being dispensed, is properly installed in the dispenser 11. If not, the program returns to the initial step of resetting the various internal registers. If the module is properly installed, on the other hand, the microprocessor extracts its eight bits of information at step 105. In step 107, a number of internal timers are then reset to zero, thus placing the system in proper condition to begin dispensing.

Figure 5B:
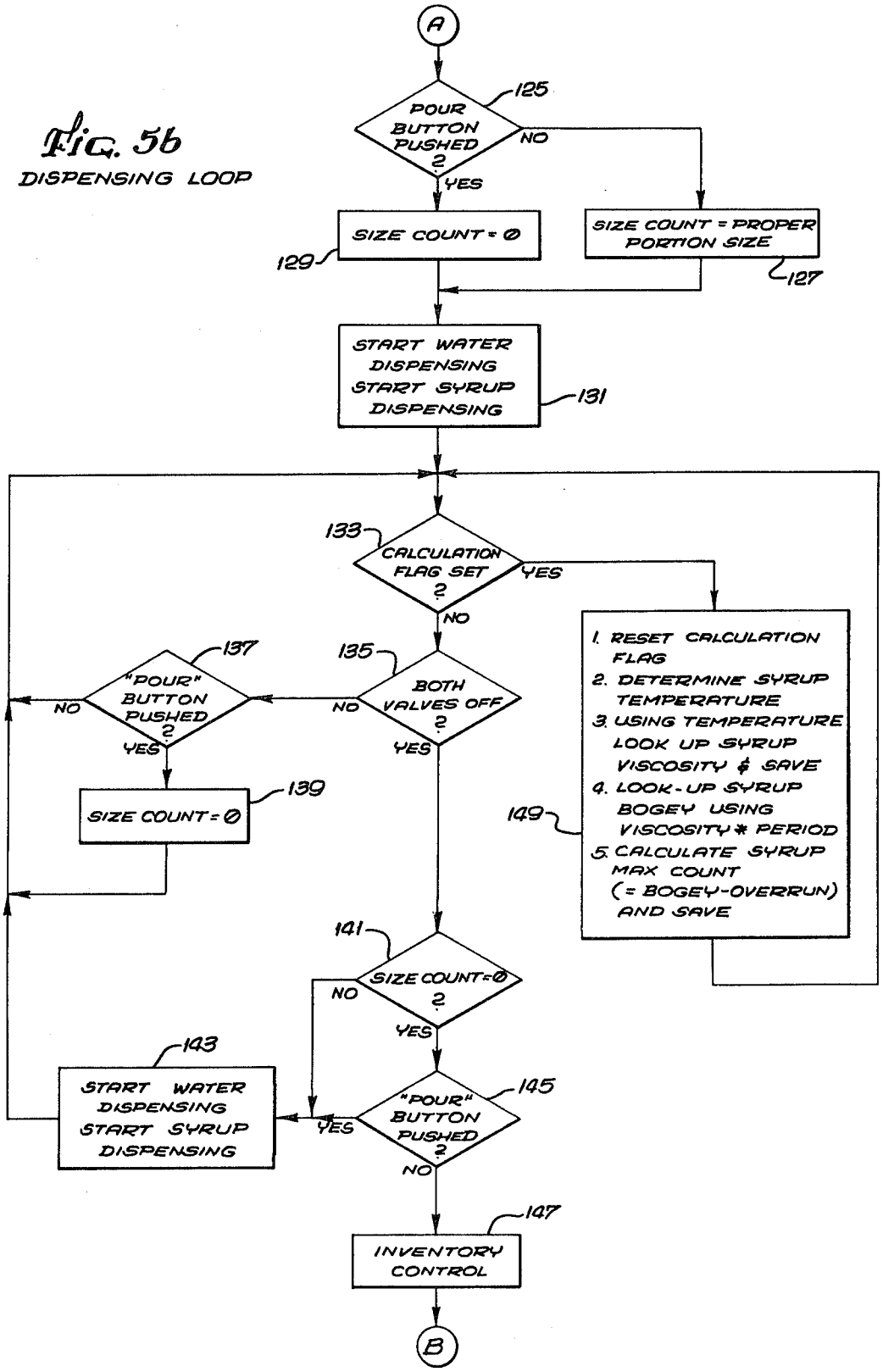

After initialization of the microprocessor 27, the program moves into the idle loop, which is depicted in the bottom half of FIG. 5*a*. In each pass through the idle loop, the microprocessor monitors the dispensing pushbuttons 61 and 63, and either monitors the multiposition switch for fine tuning the mix ratio or performs an A/D conversion on the four portion adjust potentiometers 69. An initial step 109 of the idle loop determines whether one of the portion size buttons 61 or the pour/cancel button 63 has been pushed. If none has, the program remains in the idle loop, whereas if one has been pushed, the program moves to the dispensing loop (FIG. 5*b*).

If step 109 indicates that a dispensing button has not been pushed, the program proceeds to step 111 where it is determined whether the multiposition switch for fine tuning the mix ratio, as contrasted with one of the four portion adjust potentiometers 69, has been selected for monitoring during the current pass through the idle loop. If the multiposition switch has been selected, step 113 retrieves the minimum water count from a particular lookup table identified by the personality module. Step 115 then sets the maximum water count, i.e., the count that triggers the microprocessor 27 to turn the water valve 15, equal to the retrieved minimum water count plus a count indicated by the multiposition switch. This sum, is stored in a prescribed register in the microprocessor and it corresponds to the number of pulses from the water flow meter 19 that are required to get the proper mix of water and syrup for one operating cycle. The program then returns to the initial step 109 of the idle loop.

If step 111 determines that one of the four portion adjust potentiometers 69 has been selected for monitoring during the current pass through the idle loop, the program proceeds to step 117, where it performs an A/D conversion on the appropriate potentiometer. Step 119 then determines whether a small or medium potentiometer was selected. If so, step 121 stores the last A/D conversion count in the appropriate one of four internal size registers in the microprocessor 27. This count represents the number of 0.15 ounce increments of syrup or water that must be dispensed to complete a drink of the selected size. On the other hand, if step 119 determines that a small or medium portion adjustment potentiometer was not selected, it is deduced that either a large or extra large portion adjust potentiometer was last selected. Step 123 then multiplies the A/D conversion count by two and stores it in the appropriate size register in the microprocessor. Multiplying the count by two effectively improves the resolution of the potentiometers for the small and medium sizes. The program then returns to the initial step 109 of the idle loop.

The program remains in the idle loop, performing a new A/D conversion on a different one of the four portion adjust potentiometers or monitoring the mix ratio switch during each pass through the loop, until step 109 determines that a dispensing button 61 or 63 has been pushed. When this occurs, the program proceeds to the dispensing loop depicted in FIG. 5*b*.

The microprocessor 27 operates in the dispensing loop whenever the dispenser 11 is dispensing a drink. An initial step 125 of the dispensing loop determines whether or not the pour/cancel button 63 has just been pushed. If not, it is deduced that one of the four portion buttons 61 has been pushed, and step 127 sets the count in an internal size count register equal to the appropriate portion size for the button pushed. This portion size, it will be recalled, is controllably set by one of the four portion adjust potentiometers 69. On the other hand, if step 125 determines that the pour/cancel button has been pushed, step 129 sets the size count register to zero. This size count register indicates the number of counts, in 0.15 ounce increments, that remain to be dispensed to complete the selected drink.

After the size count register has been loaded with the appropriate count, step 131 resets internal syrup and water counters to zero and presets internal syrup and water prescaler counters to prescribed negative numbers corresponding to the numbers of pulses from the respective syrup and water flowmeters 17 and 19 that must occur for 0.15 ounces of either syrup or water to be dispensed. Step 131 also initiates the first cycle of syrup and water dispensing, by transmitting the syrup and water valve drive signals to the syrup valve 13 and the water valve 15, respectively. In some situations, it might be desirable to delay opening of the syrup valve to compensate for inherent delays in the output of water by the mixing chamber assembly 23.

After the dispenser 11 has begun dispensing both water and syrup, step 133 determines whether or not a calculation flag has been set. This flag is set in the clock interrupt program (FIGS. 6*a* and 6*b*) at a prescribed point in the dispensing cycle, so that certain calculations are made at an appropriate time. If the calculation flag has not been set, the program proceeds to step 135 where the microprocessor 27 determines whether both the syrup valve 13 and the water valve 15 are off. If not, it is deduced that a drink is still being dispensed, and step 137 determines whether the pour/cancel button 63 has been pushed. If it has been pushed, it is deduced that the operator wishes to terminate dispensing of the drink and step 139 sets the count in the size count register to zero. The program then returns to step 133 where it determines whether or not a calculation flag has been set. On the other hand, if step 137 determines that the pour/cancel button has not been pushed, the count in the size counter is retained and the program returns to the calculation flag step.

If step 135 determines that both the syrup valve and the water valve are off, the program proceeds to step 141, where it is determined if the count currently stored in the size count register equals zero. If it is not, the microprocessor 27 deduces that additional syrup and water must be dispensed, so step 143 restarts the dispensing of syrup and water and the program returns to the initial calculation flag step 133. On the other hand, if step 141 determines that the size count is presently zero, the program proceeds to step 145 where it is determined whether or not the pour/cancel button 63 is still being pushed. If it is, step 143 reinitiates dispensing of the syrup and water. If the pour/cancel button is not being pushed, on the other hand, it is deduced that the dispensing of a drink has been completed and the program proceeds to step 147 where the data stored in the various internal registers of the microprocessor are appropriately formatted for coupling over line 91 to an inventory control system.

At some point during each cycle of dispensing 0.15 ounces of syrup, the clock interrupt program (FIGS. 6*a* and 6*b*) sets the calculation flag, and this fact is determined in step 133. Step 149 then performs a number of functions necessary for proper control of the remainder of the current dispensing cycle. In particular, step 149 resets the calculation flag and performs an A/D conversion of the voltage output by the temperature sensor 85. Using this temperature measure it then determines the syrup's viscosity in the particular temperature/viscosity lookup table identified by the personality module for this syrup. Based on this viscosity number and on the average period calculation for this dispensing cycle it determines the nominal maximum count of syrup pulses necessary to dispense 0.15 ounces of syrup. Finally, step 149 adjusts this nominal count by the overrun count saved from the last dispensing cycle. When the number of syrup flow meter pulses for the present dispensing cycle reaches this count, the interrupt program closes the syrup valve 13. After step 149 completes its calculations, the program returns to the initial calculation flag step 133.

Figure 6A:
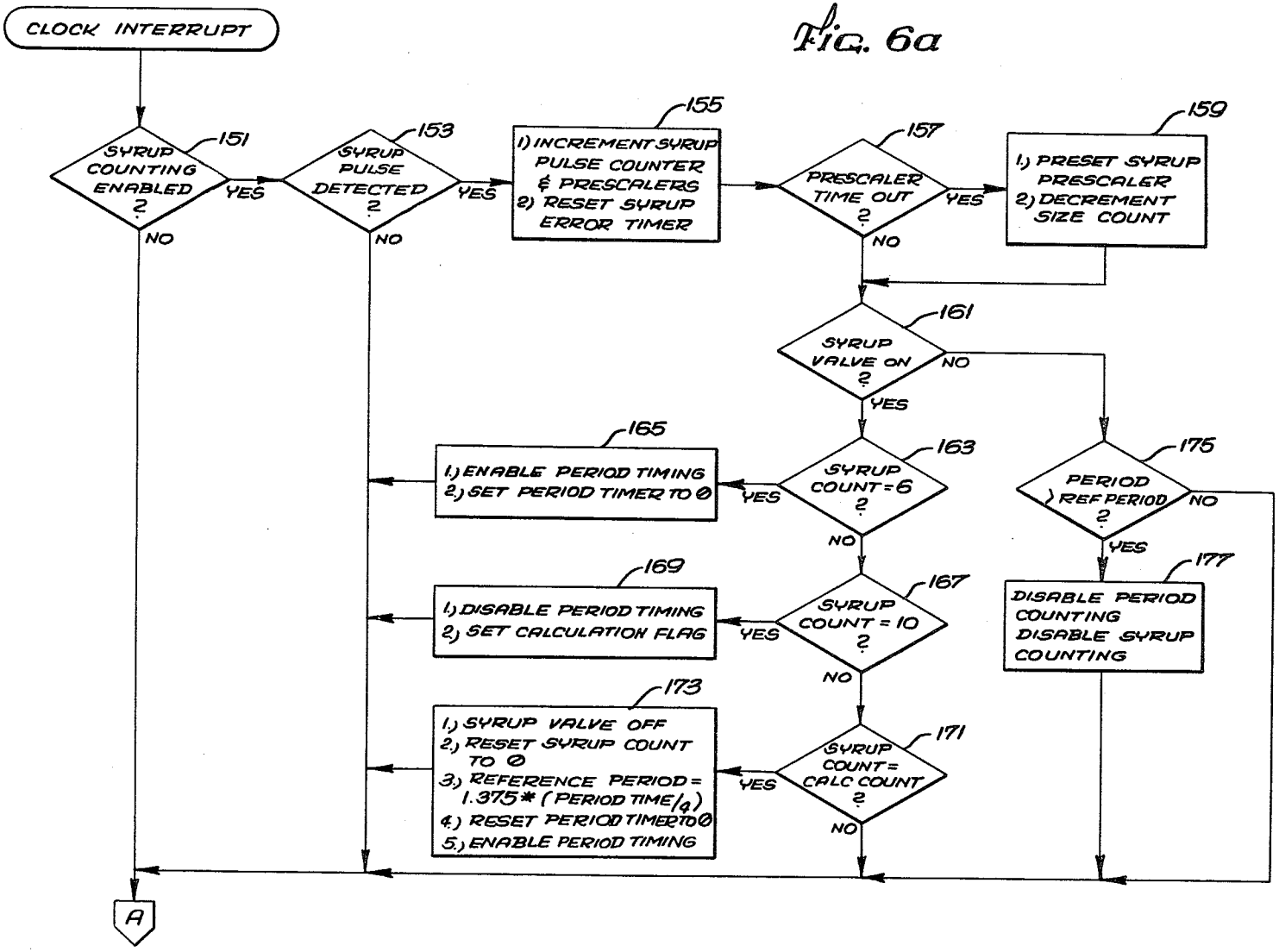
Figure 6B:
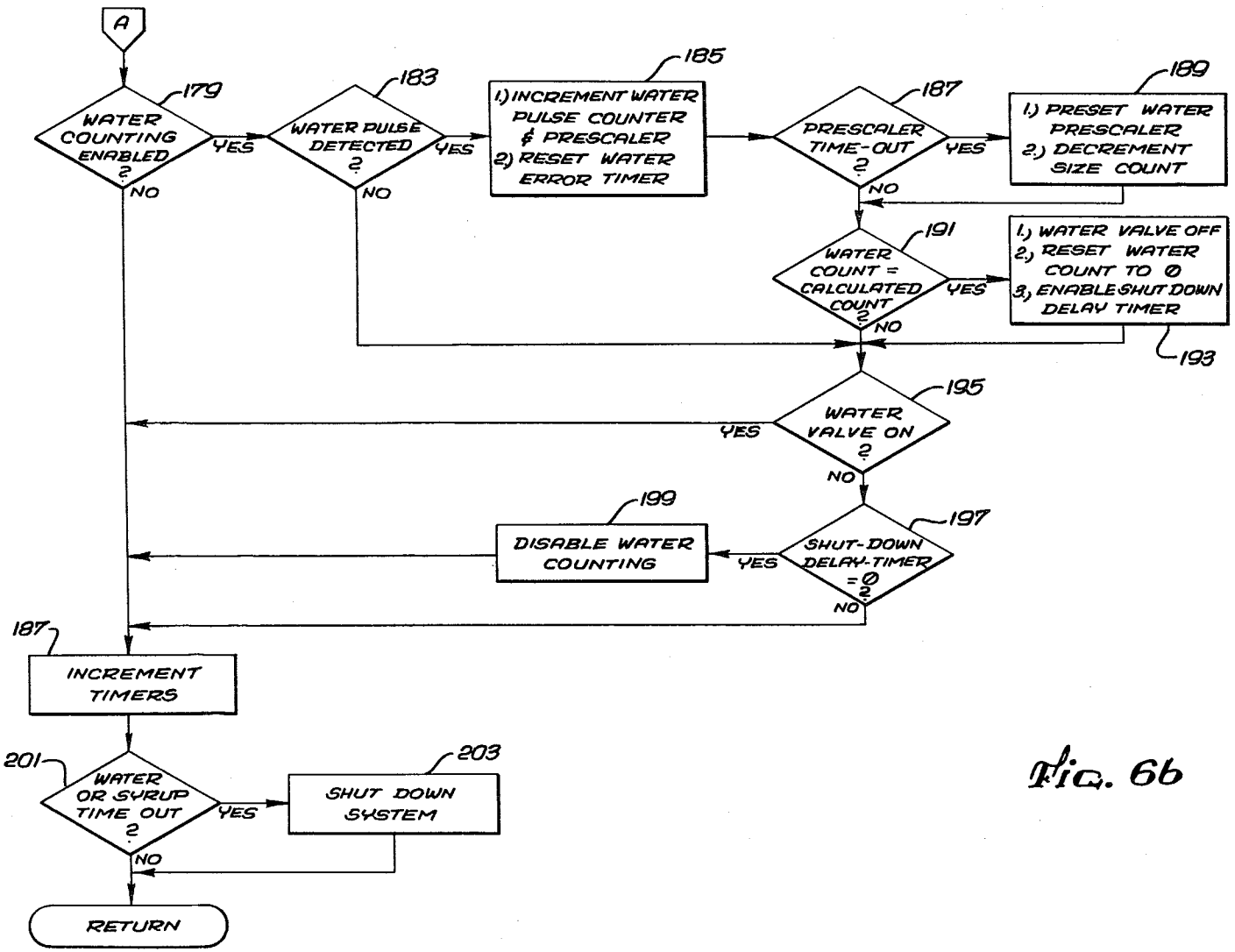

The clock interrupt program depicted in FIGS. 6*a* and 6*b* is followed once every 0.8 milliseconds, regardless of the particular step of the idle loop (FIG. 5*a*) or dispensing loop (FIG. 5*b*) currently being carried out. In general, the interrupt program increments a number of timers and scans the pulse inputs from the syrup and water flow meters 13 and 15, respectively.

Referring now to FIG. 6*a*, an initial step 151 of the clock interrupt program determines whether or not syrup counting (see FIG. 3*b*) is enabled. If it is not, all of the remaining steps depicted in FIG. 6*a* are bypassed and the program proceeds to the portion of the clock interrupt program depicted in FIG. 6*b*. On the other hand, if step 151 determines that syrup counting is enabled, the program proceeds to step 153 where it determines whether or not a syrup pulse has been output by the syrup flow meter 13 during the previous 0.8 milliseconds. If not, the program bypasses all of the remaining steps depicted in FIG. 6*a* and proceeds to the steps depicted in FIG. 6*b*.

If step 153 determines that a syrup pulse has been produced in the previous 0.8 milliseconds, step 155 increments the syrup pulse counter and the syrup prescaler counter and resets a syrup error timer. The syrup pulse counter is used to count the pulses in the pulse sequence signal output by the syrup flow meter 13 during the current dispensing cycle. The prescaler counter is used repeatedly to output a pulse to decrement the internal size counter each time the dispenser 11 has dispensed another 0.15 ounces of syrup. The syrup error timer is used in a fault recognition segment of the program described later. Step 157 then determines whether or not the prescaler counter has timed out. If it has, step 159 presets the prescaler counter to the count that must be accumulated before it is determined that another 0.15 ounces of syrup has been dispensed. Step 159 also decrements the count stored in the size counter, which as previously mentioned stores a count indicating the number of 0.15 ounce increments that must be dispensed to complete the drink selected.

After step 159 has decremented the size count or after step 157 has determined that the prescaler count has not yet reached zero, the program proceeds to step 161 where it is determined whether or not the syrup valve 13 is open. If the valve is open, indicating that syrup is still being dispensed, the program proceeds to a number of steps that determine the average pulse period between the sixth pulse and the tenth pulse of the current dispensing cycle. In particular, step 163 determines whether or not the syrup count, i.e., the count of syrup pulses that have occurred in the current dispensing cycle, is equal to six. If it is, step 165 sets a period timer to zero and enables it to begin timing the next four pulse periods, and the program then proceeds to the steps depicted in FIG. 6*b*. On the other hand, if step 163 determines that the syrup count does not equal six, the program proceeds to step 167 where it is determined whether or not the syrup count is equal to 10. If it is, step 169 disables the period timer and sets the calculation flag, which will trigger steps 133 and 149 when the program returns to the dispensing loop (FIG. 5*b*). After step 169 sets the calculation flag, the program then proceeds to the steps depicted in FIG. 6*b*.

If step 167 determines that the syrup count is not equal to 10, the program proceeds to step 171, where it is determined whether or not the syrup count is equal to the calculated maximum syrup count. If it is not, it is reduced that additional syrup needs to be dispensed and the program proceeds to the steps depicted in FIG. 6*b*. On the other hand, if step 171 determines that the syrup count does equal the calculated maximum count, step 173 closes the syrup valve 13 and sets the syrup counter to zero. It also calculates a reference period of 1.375 times the average pulse period indicated by the period timer (step 169), resets the period timer to zero, and enables timing of the next successive pulse period. The program then proceeds to the steps depicted in FIG. 6*b*.

Returning to step 161, if it is determined that the syrup valve 13 is closed, meaning that the dispensing cycle has been completed and that the overrun count is being determined, step 175 compares the time period currently stored in the period timer to the reference period calculated in step 173. If the last pulse period does not exceed this reference period, it is determined that the paddle wheel of the syrup flow meter 17 has not yet slowed down sufficiently and the overrun period is still occurring. On the other hand, if the period does exceed the reference period, step 177 disables the period counter and disables the syrup counter, to terminate the counting of syrup pulses. The program then proceeds to the steps depicted in FIG. 6*b*.

The remainder of the interrupt program is depicted in FIG. 6*b*. An initial step 179 determines whether water counting is enabled (see FIG. 4*b*). If it is not, the program proceeds to step 181, which increments all of the various timers in the microprocessor 27. On the other hand, if step 179 determines that water counting is enabled, the program proceeds to step 183, where it is determined whether a water pulse has occurred during the previous 0.8 milliseconds. If it has, step 185 increments the water pulse counter and the water prescaler counter and resets a water error timer. Step 187 then determines whether the water prescaler counter has reached zero, indicating that 0.15 ounces of water has been dispensed since the prescaler counter was last preset. If it has, step 189 presets the prescaler once again, so that counting for the next 0.15 ounce segment can begin, and decrements the size count for the drink currently being dispensed. The program then proceeds to step 191, where the current water pulse count is compared to the calculated maximum count for the current cycle. If it equals the calculated count, step 193 closes the water valve 15, resets the water count to zero, and enables an internal shutdown delay timer.

After step 193 enables the shutdown delay timer, or after step 183 determines that a water pulse has not occurred during the previous 0.8 milliseconds, or after step 191 determines that the water count does not equal the calculated maximum count, the program proceeds to step 195, where it is determined whether or not the water valve 15 is open. If it is, the program proceeds to step 181, where the various timers are incremented. On the other hand, if it is determined that the water valve is off, step 197 determines whether or not the shutdown delay timer has timed out. If it has, then it is deduced that the dispenser 11 has reached time C in FIG. 4, and step 199 disables further water pulse counting. On the other hand, if the shutdown delay timer has not yet timed out, the program proceeds to the step 181 of incrementing the timers.

Finally, step 201 determines whether the syrup error timer or the water error timer has exceeded a prescribed time threshold, indicating that a malfunction in the corresponding flow meter 13 or 15 has occurred. In particular, it might indicate that the flow meter has become locked in one position and thus not outputting any pulses or that the flow rate is extremely high, in which case bandlimiting of the flow meter pulse sequence signal would reduce its amplitude so as to make it undetectable. If step 201 determines that either timer has exceeded the prescribed threshold, step 203 shuts down the entire dispenser system. The program then returns to the location it was in immediately prior to the jump to the clock interrupt program.

It should be appreciated from the foregoing description that the present invention provides an improved post mix soft drink dispensing apparatus and method that dispenses soft drinks with accurate relative proportions of carbonated water and soft drink syrup. The water and syrup are supplied using valves that are turned on and off, separately, at prescribed duty cycles, to accurately and reliably provide a prescribed mix ratio. Also, flow meters monitor the instantaneous flow rates of both the water and the syrup, to increase the accuracy of the mix ratio the apparatus provides. The apparatus is thereby particularly insensitive to any variations in the original pressure of the carbonated water.

Although the invention has been described in detail with reference to the presently preferred embodiment, it should be understood by those of ordinary skill in the art that various modifications can be made without departing from the scope of the invention. Accordingly, the invention is limited only by the following claims.

We claim:

1. Apparatus for mixing together and dispensing a first fluid and a second fluid in prescribed relative proportions, comprising:

first valve means for controllably supplying a first fluid, the fluid having a variable viscosity and the flow rate of the supplied first fluid varying in accordance with its viscosity;

second valve means for controllably supplying a second fluid;

means for mixing together and dispensing the first and second fluids supplied by the respective first and second valve means;

means for determining the viscosity of the first fluid supplied by the first valve means, including removable module means indicating the relationship between viscosity and temperature for the first fluid, means for carrying the removable module means and for reading it to determine the relationship between vicosity and temperature for the first fluid, and means for measuring the temperature of the first fluid and for transforming the temperature measurement into a corresponding viscosity determination; and control means responsive to the viscosity determination for modulating at least one of the first and second valve means in a prescribed fashion, such that the apparatus dispenses the first and second fluids in prescribed relative proportions.

2. Apparatus as defined in claim 1, wherein:

the apparatus further includes first flow meter means for sensing the instantaneous flow rate of the first fluid supplied by the first valve means and for producing a corresponding first velocity signal that varies in accordance with both the actual flow rate of the first fluid and the viscosity of the first fluid; and the control means includes means for adjusting the first velocity signal produced by the first flow meter means to reflect the effect that viscosity has on the signal, and means responsive to the adjusted first velocity signal for modulating at least one of the first and second valve means in the prescribed fashion, such that the apparatus dispenses the first and second fluids in prescribed relative proportions.

3. Apparatus as defined in claim 1, wherein the removable module means includes indicia identifying the first fluid supplied by the first valve means, the indicia being visible from the exterior of the apparatus.

4. A method for mixing together and dispensing a first fluid and a second fluid in prescribed relative proportions, comprising steps of:

controllably supplying a first fluid, the fluid having a variable viscosity and the flow rate of the supplied first fluid varying in accordance with its viscosity;

controllably supplying a second fluid;

mixing together and dispensing the first and second fluids supplied in the respective first and second steps of controllably supplying; and determining the viscosity of the first fluid supplied in the first step of controllably supplying, including steps of supporting a removable module means indicating the relationship between viscosity and temperature for the first fluid, reading the removable module means to determine the relationship between viscosity and temperature for the first fluid, and measuring the temperature of the first fluid and transforming the temperature measurement into a corresponding viscosity determination;

wherein one of the first and second steps of controllably supplying includes a step of modulating the supplying of the fluid in a prescribed fashion, such that the method dispenses the first and second fluids in prescribed relative proportions.

5. A method as defined in claim 4, wherein:

the method further includes a step of sensing the instantaneous flow rate of the first fluid supplied by the first step of controllably supplying and producing a corresponding first velocity signal that varies in accordance with both the actual flow rate of the first fluid and the viscosity of the first fluid; and the step of modulating includes steps of adjusting the first velocity signal produced by the step of sensing and producing to reflect the effect that viscosity has on the signal, and modulating at least one of the first and second valve means in accordance with the adjusted first velocity signal, such that the method dispenses the first and second fluids in prescribed relative proportions.

6. Apparatus for mixing together and dispensing a first fluid and a second fluid in prescribed relative proportions, comprising:

first valve means for controllably supplying a first fluid, the fluid having a variable viscosity;

first flow meter means for sensing the instantaneous flow rate of the first fluid supplied by the first valve means and for producing a corresponding first velocity signal, the first velocity signal varying in accordance with both the actual flow rate of the first fluid and the viscosity of the first fluid;

second valve means for controllably supplying a second fluid;

means for mixing together and dispensing the first and second fluids supplied by the respective first and second valve means;

means for determining the viscosity of the first fluid supplied by the first valve means and for adjusting the first velocity signal produced by the first flow meter to reflect the effect that viscosity has on the signal; and control means responsive to the adjusted velocity signal for modulating on and off a selected one of the first and second valve means at a prescribed duty cycle, such that the selected valve means supplies its fluid at a prescribed average flow rate and such that the apparatus dispenses the first and second fluids in prescribed relative proportions, wherein the selected one of the first and second valve means supplies a predetermined constant volume of its fluid during each of the successive time periods it is modulated on by the control means, and wherein the other valve means supplies a predetermined constant volume of its fluid during each of the successive time periods marked by the control means first turning on the selected valve means.

7. Apparatus as defined in claim 6, wherein:

the apparatus further includes second flow meter means for sensing the instantaneous flow rate of the second fluid supplied by the second valve means and for producing a corresponding second velocity signal; and the control means is responsive to both the adjusted first velocity signal and the second velocity signal, to modulate the selected one of the first and second valve means in the prescribed fashion.

8. Apparatus as defined in claim 6, wherein:

the viscosity of the first fluid varies according to its temperature; and the means for determining viscosity includes means for measuring the temperature of the first fluid and means for transforming the temperature measurement into a corresponding viscosity measurement.

9. Apparatus as defined in claim 8, wherein the means for determining viscosity further includes:

removable module means indicating the relationship between temperature and viscosity for the first fluid; and means for carrying the removable module means and for reading it to determine the relationship between temperature and viscosity for the first fluid.

10. Apparatus as defined in claim 9, wherein the removable module means includes indicia identifying the first fluid supplied by the first valve means, the indicia being visible from the exterior of the apparatus.

11. Apparatus as defined in claim 6, wherein:
the apparatus further includes removable module means indicating the prescribed relative proportions of the first and second fluids; and
the control means includes means for carrying the removable module means and reading it to determine the prescribed relative proportions of the first and second fluids.

12. Apparatus as defined in claim 11, wherein the removable module means includes indicia identifying the first fluid supplied by the first valve means, the indicia being visible from the exterior of the apparatus.

13. A method for mixing together and dispensing a first fluid and a second fluid in prescribed relative proportions, comprising steps of:
controllably supplying a first fluid using a first valve means, the fluid having a variable viscosity;
sensing the instantaneous flow rate of the first fluid supplied by the first step of controllably supplying and producing a corresponding first velocity signal, the first velocity signal varying in accordance with both the actual flow rate of the first fluid and the viscosity of the first fluid;
controllably supplying a second fluid using a second valve means;
mixing together and dispensing the first and second fluids supplied by the respective first and second steps of controllably supplying;
determining the viscosity of the first fluid supplied by the first step of controllably supplying and adjusting the first velocity signal to reflect the effect that viscosity has on the signal; and
modulating on and off a selected one of the first and second valve means at a prescribed duty cycle determined in accordance with the adjusted velocity signal, such that the selected valve means supplies its fluid at a prescribed average flow rate and such that the method dispenses the first and second fluids in prescribed relative proportions, wherein the selected one of the first and second valve means supplies a predetermined constant volume of its fluid during each of the successive time periods it is modulated on, and wherein the other valve means supplies a predetermined constant volume of its fluid during each of the successive time periods marked by the successive times the selected valve means is first turned on.

14. A method as defined in claim 13, wherein the step of modulating includes a step of carrying and reading a removable module means to determine the prescribed relative proportions of the first and second fluids.

15. A method as defined in claim 13, wherein:
the method further includes a step of sensing the instantaneous flow rate of the second fluid supplied by the second step of controllably supplying and producing a corresponding second velocity signal; and
the step of modulating is performed in accordance with both the adjusted first velocity signal and the second velocity signal, to modulate the selected one of the first and second valve means in the prescribed fashion.

16. A method as defined in claim 13, wherein:
the viscosity of the first fluid varies according to its temperature; and
the step of determining viscosity includes a step of measuring the temperature of the first fluid and transforming the temperature measurement into a corresponding viscosity measurement.

17. A method as defined in claim 16, wherein the step of determining viscosity further includes steps of carrying and reading a removable temperature and viscosity module for the first fluid.

18. Apparatus for dispensing a first fluid and a second fluid in prescribed relative proportions, comprising:
first means for controllably supplying a first fluid;
second means for controllably supplying a second fluid;
means for mixing together and dispensing the fluids supplied by the first means and the second means;
removable module means indicating the prescribed relative proportions of the first fluid and the second fluid;
means for monitoring the removable module means to determine the prescribed relative proportions of the first fluid and the second fluid;
means for modulating a selected one of the first means and second means in a prescribed fashion, such that the mixing means dispenses the first and second fluids in the prescribed relative proportions;
means for sensing the absence of the removable module means and for producing a corresponding inhibit signal; and
means responsive to the inhibit signal for inhibiting the first means and the second means from supplying fluid.

19. Apparatus for dispensing a first fluid and a second fluid in prescribed relative proportions, comprising:
first means for controllably supplying a first fluid;
second means for controllably supplying a second fluid;
means for mixing together and dispensing the fluids supplied by the first means and the second means;
means for modulating a selected one of the first means and second means in a prescribed fashion, such that the mixing means dispenses the first and second fluids in prescribed relative proportions;
means for sensing the flow rate of the first fluid supplied by the first means and for producing a pulse signal having a frequency indicative of its flow rate;
means for monitoring the pulse signal and producing a period reference corresponding to the average period between the successive pulses; and
means for comparing each period between the successive pulses of the pulse signal with the period reference and disabling the first means whenever it differs from the period reference by more than a prescribed amount.

20. Apparatus for dispensing a first fluid and a second fluid in prescribed relative proportions, comprising:
first means for controllably supplying a first fluid;
second means for controllably supplying a second fluid;
means for mixing together and dispensing the fluids supplied by the first means and the second means; and
means for modulating the first means in accordance with a control signal that varies with time in a prescribed fashion, such that it supplies the first fluid at an average flow rate that varies with time, whereby the apparatus dispenses the first and second fluids in relative proportions that vary with time.

21. Apparatus for dispensing a first fluid and a second fluid in prescribed relative proportions, comprising:
first means for controllably supplying a first fluid;
second means for controllably supplying a second fluid;
means for mixing together and dispensing the fluids supplied by the first means and the second means; and
means for modulating both the first means and the second means in accordance with a control signal that varies with time in a prescribed fashion, such that the first means and the second means supply fluids at average flow rates that vary together with time, and such that the apparatus dispenses the first and second fluids in prescribed relative proportions.

22. Apparatus for dispensing a fluid at a prescribed average flow rate, comprising:

fluid supply means including valve means for controllably turning on and off a fluid supply;

means for sensing the instantaneous flow rate of the fluid dispensed by the fluid supply means and for producing a corresponding velocity signal;

means for conditioning the velocity signal in a prescribed fashion to produce a valve control signal for coupling to the valve means to turn on and off the fluid supply at a prescribed duty cycle, such that the fluid supply means dispenses the fluid at a prescribed average flow rate;

wherein the velocity signal decreases uniformly each time the valve means turns off the fluid supply, and the valve means turns off the fluid supply a variable time period after the valve control signal terminates;

means for comparing the velocity signal to a prescribed threshold, to produce an estimate of the time the valve means actually turns off the fluid supply; and means for measuring the time delay between termination of the valve control signal and the estimate of the time the valve means actually turns off the fluid supply, to produce a time delay measurement, wherein the means for conditioning adjusts the valve control signal in accordance with the time delay measurement.

23. A method for dispensing a first fluid and a second fluid in prescribed relative proportions, comprising steps of:

controllably supplying a first fluid using a valve means;

controllably supplying a second fluid;

mixing together and dispensing the fluids supplied by the first and second steps of controllably supplying;

monitoring a removable module means to determine the prescribed relative proportions of the first fluid and the second fluid;

wherein the first step of controllably supplying includes a step of modulating the valve means in a prescribed fashion, independent of the second step of controllably supplying, such that the method dispenses the first and second fluids in prescribed relative proportions;

sensing the absence of the removable module means, and producing a corresponding inhibit signal; and terminating the first and second steps of controllably supplying, in response to the inhibit signal.

24. A method for dispensing a first fluid and a second fluid in prescribed relative proportions, comprising steps of:

controllably supplying a first fluid using a valve means;

controllably supplying a second fluid;

mixing together and dispensing the fluids supplied by the first and second steps of controllably supplying;

wherein the first step of controllably supplying includes a step of modulating the valve means in a prescribed fashion, independent of the second step of controllably supplying, such that the method dispenses the first and second fluids in prescribed relative proportions;

sensing the flow rate of the first fluid supplied in the first step of controllably supplying, and producing a pulse signal having a frequency indicative of its flow rate;

monitoring the pulse signal and producing a period reference corresponding to the average period between the successive pulses; and comparing each period between the successive pulses of the pulse signal with the period reference, and terminating the first step of controllably supplying whenever it differs from the period reference by more than a prescribed amount.

25. A method for dispensing a first fluid and a second fluid in prescribed relative proportions, comprising steps of:

controllably supplying a first fluid using a valve means;

controllably supplying a second fluid; and mixing together and dispensing the fluids supplied by the first and second steps of controllably supplying;

wherein the first step of controllably supplying includes a step of modulating the valve means in accordance with a control signal that varies with time in a prescribed fashion, such that the first step of controllably supplying supplies the first fluid at an average flow rate that varies with time, whereby the method dispenses the first and second fluids in relative proportions that vary with time.

26. A method for dispensing a first fluid and a second fluid in prescribed relative proportions, comprising steps of:

controllably supplying a first fluid using a first valve means;

controllably supplying a second fluid using a second valve means; and mixing together and dispensing the fluids supplied by the first and second steps of controllably supplying;

wherein the first and second steps of controllably supplying both include steps of modulating the respective valve means in accordance with a control signal that varies with time in a prescribed fashion, such that the first and second steps of controllably supplying both supply fluids at average flow rates that vary together with time, and such that the method dispenses the first and second fluids in prescribed relative proportions.

27. A method for dispensing a fluid at a prescribed average flow rate, comprising steps of:

controllably turning on and off a valve means for dispensing a fluid;

sensing the instantaneous flow rate of the fluid dispensed by the valve means and producing a corresponding velocity signal;

conditioning the velocity signal in a prescribed fashion to produce a valve control signal for coupling to the valve means to turn it on and off at a prescribed duty cycle, such that the valve means dispenses the fluid at a prescribed average flow rate;

wherein the velocity signal produced in the step of sensing decreases uniformly after the valve means is turned off, and the valve means turns off the fluid supply a variable time period after the valve control signal terminates;

comparing the velocity signal to a prescribed threshold, to produce an estimate of the time the valve means actually turns off; and measuring the time delay between termination of the valve control signal and the estimate of the time the valve means actually turns off the fluid supply, to produce a time delay measurement, wherein the step of conditioning includes a step of adjusting the valve control signal in accordance with the time delay measurement.

* * * * *